US005423107A

United States Patent [19]

Thrash

[11] Patent Number: 5,423,107

[45] Date of Patent: Jun. 13, 1995

[54] ABRASIVE SEED DELINTING WITH COTTONSEED REFRIGERATION

[75] Inventor: Tommy K. Thrash, Lubbock, Tex.

[73] Assignee: Associated Farmers Delinting, Inc., Littlefield, Tex.

[21] Appl. No.: 100,670

[22] Filed: Jul. 30, 1993

[51] Int. Cl.[6] ..... D01B 1/04

[52] U.S. Cl. ..... 19/40; 19/41; 19/64.5; 19/66 CC

[58] Field of Search ..... 19/39, 40, 41, 48 R, 19/66 R, 66 CC, 64.5; 47/58.01, 58.02, 58.15; 62/381, 374, 304, 314; 241/6, 8

[56] References Cited

U.S. PATENT DOCUMENTS

| | | | |
|---|---|---|---|
| 431,949 | 7/1890 | Marshall | 19/41 |
| 1,846,510 | 2/1932 | Busse | 47/58.02 |
| 2,166,974 | 7/1939 | Shields | 19/66 R |
| 3,320,640 | 5/1967 | Van Doorn | 19/64.5 |
| 4,090,669 | 5/1978 | Lermuzeaux | 241/8 |
| 4,569,204 | 2/1986 | Ott et al. | 62/381 |
| 4,798,614 | 1/1989 | Aubry et al. | 62/381 |
| 4,856,285 | 8/1989 | Acharya et al. | 62/374 |
| 4,942,643 | 7/1990 | Kincer et al. | 19/44 |

FOREIGN PATENT DOCUMENTS

| | | | |
|---|---|---|---|
| 1362755 | 12/1986 | U.S.S.R. | 19/40 |
| 1440965 | 11/1988 | U.S.S.R. | 19/40 |

*Primary Examiner*—Clifford D. Crowder
*Assistant Examiner*—Michael A. Neas
*Attorney, Agent, or Firm*—Wendell Coffee

[57] ABSTRACT

Cotton seed are mechanically delinted by a process such as abrasion. To prevent the heat produced by the mechanical delinting from damaging the germination of the seed, the seed are mechanically cooled, or chilled, or refrigerated, to prevent the interior of the seed from being heated above 140°. One method of chilling the seed is by spraying the seed with liquid nitrogen immediately before delinting.

4 Claims, 1 Drawing Sheet

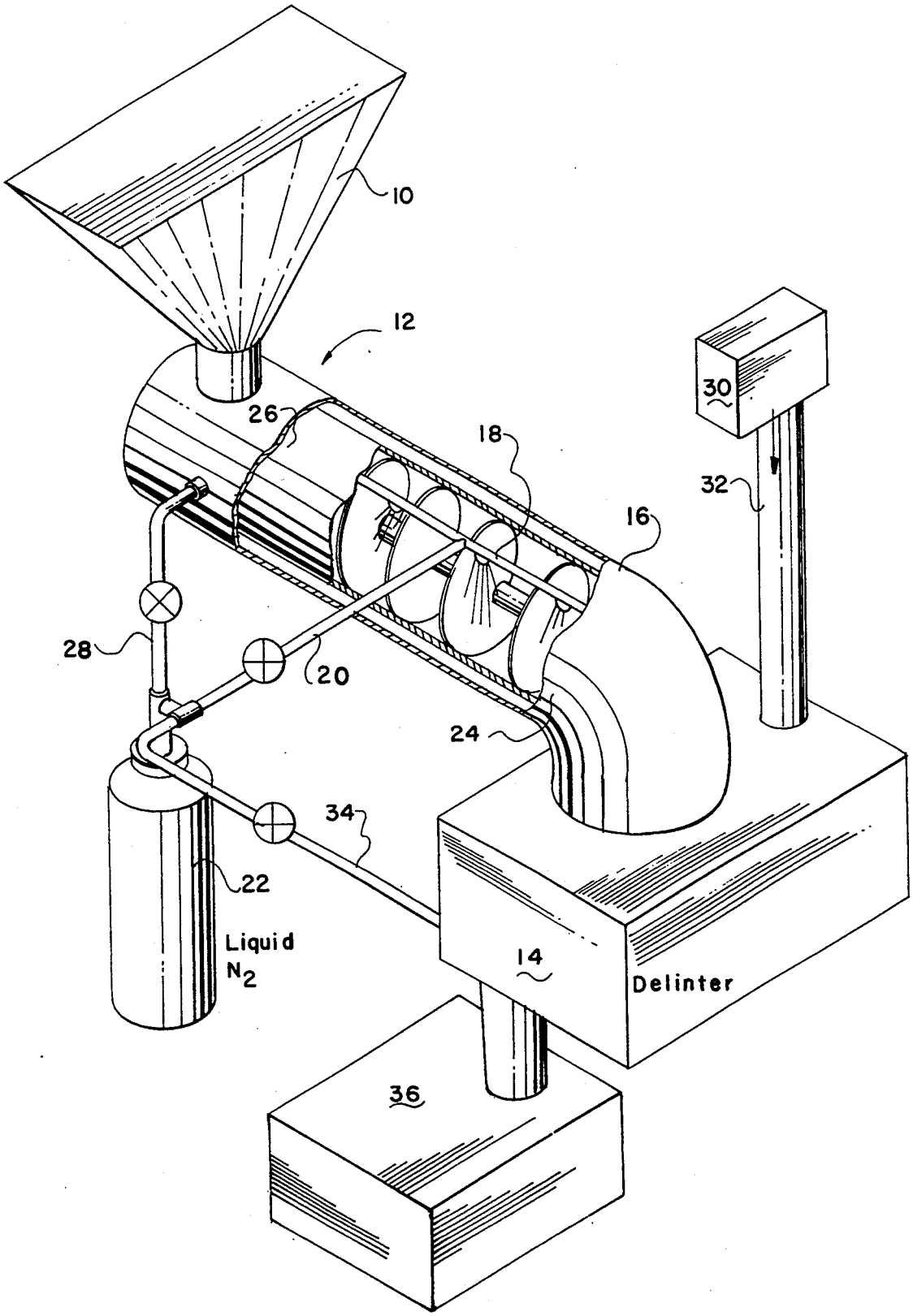
10
12
26
18
30
32
16
28
20
24
34
22
Liquid
$N_2$
14
Delinter
36

ABRASIVE SEED DELINTING WITH COTTONSEED REFRIGERATION

CROSS REFERENCE TO RELATED APPLICATION

None, however, Applicant filed Disclosure Document Number 322,054 on Dec. 8, 1992 which document concerns this application; therefore, by separate paper it is respectfully requested that the document be retained and acknowledgment thereof made by the Examiner.

BACKGROUND OF THE INVENTION (1) Field of the Invention

This invention relates to the preparation of cotton seed for planting by mechanical delinting. More particularly this invention relates to preventing damage to the seed from heating caused by mechanical delinting such as abrading. Cotton farmers have ordinary skill in this art.

(2) Description of the Related Art

Cotton seed delinting has been known for over 100 years. A machine for abrasive delinting seed was on the market for many years known as the Buckeye machine. The cotton seed were delinted by feeding the seed into a horizontal rotating drum. The drum had abrading surfaces thereon. As the seed were rotated through the drum the lint would be rubbed from the seed.

KINCER, U.S. Pat. No. 4,942,643 (hereinafter referred to as '643 patent) discusses other abrading methods for delinting cottonseed.

The '643 patent contains an extensive description of cottonseed delinting, both chemical and mechanical.

As used in this application, the term "mechanical delinting" or "mechanical action during delinting" refers not only to the type of machine as described in the '643 patent, but to other type machines such as those identified as abrasion delinting. Stated otherwise, the term, "mechanical delinting" or "mechanical action delinting" is used in opposition to the term, "chemical delinting".

The '643 patent says that the cotton seed for planting should not be heated to a temperature above 140°. This temperature relates to the germ of a seed. The '643 patent emphasizes the importance of having air ventilation through a mechanical action delinting machine.

As used herein the term, "refrigerating" refers to cooling which does not occur in nature. "Mechanical refrigeration" refers to the common type refrigeration cycle in which a gas is compressed and then condensed by removing the heat of condensation. The condensate thereafter evaporates thereby absorbing the heat of evaporation. "Refrigerated air" refers to air which has been cooled either by mechanical refrigeration or by other process, such as by evaporation of mechanically pumped water.

SUMMARY OF THE INVENTION (1) Progressive Contribution to the Art

This invention concerns mechanical action delinting of cotton seed to be used as planting seed. The main draw back of mechanical action delinting for cotton seed is the heat generated during the process. The heat damages the germination of the seed. This invention solves that problem by refrigerating the seed.

Various methods may be used for refrigerating the seed, such as blowing refrigerated air over the seed, or passing the seed in a conveyor through a jacketed chamber. An example of such a system as this is to convey the seed by an auger surrounded by a cylindrical tube having a refrigerated jacket carrying a mechanically refrigerated fluid.

The seed may be refrigerated before the seed are delinted. The seed may be cooled by refrigerated air during the delinting process. The seed may be refrigerated by spraying liquid nitrogen upon the seed.

If the delinting process is carried out quickly enough the seed may be immediately chilled thereafter, as for example, immersing the seed in the liquid nitrogen. The seed must be chilled before the heat from the outer surfaces reaches the germ within the seed to preserve germination.

It has been determined that chilling the seed to extremely low temperatures, even as low as the temperature of liquid nitrogen at atmospheric pressures, is not detrimental to the seed or their germination. In fact there is some indication that such an extreme chilling of the seed improves germination.

Liquid nitrogen is an acceptable refrigerant to apply to the seed. Although an atmosphere of pure nitrogen would choke animals or people, it is not toxic. Inasmuch as the atmosphere is about 4/5 nitrogen, the discharge of nitrogen to the atmosphere is not harmful unless it reaches a concentration sufficient to exclude oxygen.

(2) Objects of this Invention

An object of this invention is to delint cottonseed quickly, and economically, without damage to the seed.

Another object is to mechanically delint cottonseed and to refrigerate the seed to prevent heat from damaging the germination of the seed.

Further objects are to achieve the above with devices that are sturdy, compact, durable, lightweight, simple, safe, efficient, versatile, ecologically compatible, energy conserving, and reliable, yet inexpensive and easy to manufacture, install, operate, and maintain.

Other objects are to achieve the above with a method that is rapid, versatile, ecologically compatible, energy conserving, efficient, and inexpensive, and does not require highly skilled people to install, operate, and maintain.

The specific nature of the invention, as well as other object, uses, and advantages thereof, will clearly appear from the following description and from the accompanying drawings, the different views of which are not necessarily scale drawings.

BRIEF DESCRIPTION OF THE DRAWINGS

The drawing is a perspective view, schematic in nature, disclosing the invention.

As an aid to correlating the terms of the claims to the exemplary drawing, the following catalog of elements and steps is provided:

| | |
|---|---|
| 10 | hopper |
| 12 | conveyor |
| 14 | delinter |
| 16 | top |
| 18 | spray head |
| 20 | tubing |
| 22 | bottle |
| 24 | housing |
| 26 | jacket |
| 28 | supplemental tubing |
| 30 | air cooler |
| 32 | air duct |
| 34 | 2nd supplemental tubing |

-continued

| | |
|---|---|
| 36 | container |

DESCRIPTION OF THE PREFERRED EMBODIMENTS

Referring to the drawing, there may be seen a typical arrangement for the practice of this invention. Fuzzy seed are placed in hopper 10 wherein the seed flow into conveyor 12 which is shown as an auger conveyer. The seeds are discharged from the auger conveyor into the mechanical action delinter 14. The conveyor has lid or top 16. Spray head 18 extends above the seed in the conveyor 12, but below top 14. The spray head is fed by appropriate tubing 20 from bottle 22. The bottle 22 is a source of liquified gas, preferably a source of liquid nitrogen.

Therefore in operation, as the seed are conveyed from the hopper 10 to the delinter 14 the seed are refrigerated by spraying liquid nitrogen directly thereon. The liquid nitrogen will rapidly evaporate, however as the nitrogen gas evaporates it will be contained by the conveyor top. Some of the gas will go toward the hopper and perhaps up the hopper and thereby chill the incoming seed before they are sprayed. The evaporated nitrogen which does not go back through the hopper would be directed toward the delinter where it would continue to chill the seed within the delinter.

Therefore it may be seen that this is a preferred way of delinting the cotton seed.

Again referring to the drawing, it may be seen that the conveyor housing 24 is double. In other words there is a space or jacket 26 between two housing walls. Another embodiment to practice this invention is providing supplemental tubing 28 extending from the bottle 22 to the jacket 26. Therefore as the seed were being conveyed from the hopper to the delinter the evaporating liquid nitrogen within the jacket will chill the seed, i.e. to artificially cool the seed or refrigerate the seed, thereby preventing heat damage to them during mechanical action delinting. Evaporated nitrogen is exhausted into the conveyer 12 further chilling the seed as described above.

An obvious variation of chilling the jacket would be to have another refrigerated fluid in the jacket 26. Obviously the other refrigerated fluid could be chilled brine, some other refrigerated gas or chilled air.

Another embodiment of the invention is to have a source of chilled air or refrigerated air. The air could be cooled by conventional methods such as a refrigerating coil having refrigerated fluid air flow over it. An evaporative air cooler known in the Southwest as a "haystack" cooler has an air permeable pad which is kept moist with water. As the air flows through the pad the water is evaporated thereby cooling the air. As shown in the drawings, cooled air from cooler 30 flows through air duct 32 to the delinter 14.

Another embodiment includes a second supplemental tubing 34 extending from the bottle 22 to the delinter 14. In this case, a liquified gas is sprayed directly into the delinter thereby spraying the seed within the delinter as the seed were being delinted by mechanical action. As stated before, the preferred liquified gas would be nitrogen.

A further method would be to quickly delint cotton seed and immediately immerse them in container 36 of a liquified gas, preferably nitrogen.

In ordinary circumstances only one of the embodiments described above would be used. However, it is understood that all the embodiments could all be combined and all practiced together. For this reason the drawing illustrates an apparatus for using all the embodiments in a single drawing figure.

Also this invention is concerned primarily with the mechanical action delinting of a cotton seed. Those having ordinary skill in the art will understand that after delinting it is common practice to coat the delinted cotton seed with a coating. A common type coating is "lignosite" which is a lignon sulphate product produced by Georgia-Gulf Corporation of Atlanta, Ga. sold in association with the Georgia Pacific Corporation of Atlanta, Ga.

The embodiments shown and described above are only exemplary. I do not claim to have invented all the parts, elements or steps described. Various modifications can be made in the construction, material, arrangement, and operation, and still be within the scope of my invention.

The restrictive description and drawings of the specific examples above do not point out what an infringement of this patent would be, but are to enable one skilled in the art to make and use the invention. The limits of the invention and the bounds of the patent protection are measured by and defined in the following claims.

I claim as my invention:

1. A method of delinting cottonseed including, a) mechanically delinting the seed thereby b) heating the cottonseed by said mechanical delinting step, and c) refrigerating the cottonseed thus d) preventing overheating of the cottonseed; wherein the step of refrigerating the cottonseed comprises:

e) conveying the cottonseed through a refrigerated jacket, and f) refrigerating the jacket by placing a refrigerated fluid therein.

2. The method as defined in claim 1 wherein the process of refrigerating the jacket is by placing liquified nitrogen therein.

3. The method as defined in claim 1 wherein the process of conveying the cottonseed is by augering the cottonseed.

4. A method of delinting cottonseed including, a) mechanically delinting the seed thereby b) heating the cottonseed by said mechanical delinting step, and c) refrigerating the cottonseed thus d) preventing overheating of the cottonseed; wherein the step of refrigerating the cottonseed comprises:

e) augering the cottonseed through a refrigerated jacket, and f) refrigerating the jacket by placing liquid nitrogen therein.

* * * * *